US008456367B2

(12) United States Patent
Chiu

(10) Patent No.: US 8,456,367 B2
(45) Date of Patent: Jun. 4, 2013

(54) MICROSTRIP FOR WIRELESS COMMUNICATION AND METHOD FOR DESIGNING THE SAME

(75) Inventor: Ta-Shun Chiu, Tu-Cheng (TW)

(73) Assignee: Chi Mei Communication Systems, Inc., New Taipei (TW)

( * ) Notice: Subject to any disclaimer, the term of this patent is extended or adjusted under 35 U.S.C. 154(b) by 406 days.

(21) Appl. No.: 12/965,908

(22) Filed: Dec. 12, 2010

(65) Prior Publication Data

US 2012/0050110 A1 Mar. 1, 2012

(30) Foreign Application Priority Data

Aug. 30, 2010 (TW) ..... 99129027

(51) Int. Cl.
*H01Q 1/38* (2006.01)
*H01Q 13/10* (2006.01)

(52) U.S. Cl.
USPC ..... 343/700 MS; 343/767

(58) Field of Classification Search
USPC ..... 343/700 MS, 702, 767
See application file for complete search history.

(56) References Cited

U.S. PATENT DOCUMENTS

| | | | | |
|---|---|---|---|---|
| 3,530,479 | A * | 9/1970 | Waldron | 343/771 |
| 5,187,489 | A * | 2/1993 | Whelan et al. | 343/767 |
| 6,281,854 | B1 * | 8/2001 | Ohoka et al. | 343/767 |
| 7,616,158 | B2 * | 11/2009 | Mak et al. | 343/700 MS |
| 8,077,096 | B2 * | 12/2011 | Chiang et al. | 343/702 |
| 8,111,204 | B2 * | 2/2012 | Croman | 343/767 |

* cited by examiner

*Primary Examiner* — Tan Ho
(74) *Attorney, Agent, or Firm* — Altis Law Group, Inc.

(57) ABSTRACT

A microstrip for wireless communication includes a main body and two connection bodies formed on the main body. The main body defines a slot therein, and the slot includes a plurality of zigzag units. Feed signals are input to and output from the main body through the two connection bodies to generate quasi-transverse electric magnetic modes (QTEM) in the main body for transmitting wireless signals. The QTEM includes an odd mode and an even mode that are both capable of transmitting the wireless signals. When the odd mode and the even mode synchronously transmits the wireless signals, the slot adjusts a length of a transmission path of signals transmitted by the odd mode, such that the phase velocity of transmitting the wireless signals by the odd mode is adjusted to substantially equal to the phase velocity of transmitting the wireless signals by the even mode.

11 Claims, 9 Drawing Sheets

| $R_1$ (Ω) | $f_0$(GHz) | $f_1$(GHz) | $Z_1$ (Ω) | $\theta_1$ | | $Z_{oo}$ (Ω) | $Z_{oe}$ (Ω) | $\theta_c$ | | Total $2\theta_1+\theta_c$ (mm) |
|---|---|---|---|---|---|---|---|---|---|---|
| | | | | degree | length (mm) | | | degree | length (mm) | |
| 100 | 2.5 | 5.8 | 95.1 | 1.23 | 0.31 | 52.7 | 95.1 | 47.69 | 11.95 | 12.57 |
| 180 | 2.5 | 5.8 | 116.8 | 1.74 | 0.44 | 69.2 | 130.5 | 48.72 | 12.35 | 13.23 |

FIG. 6

MICROSTRIP FOR WIRELESS COMMUNICATION AND METHOD FOR DESIGNING THE SAME

BACKGROUND

1. Technical Field

The present disclosure relates to wireless communication, and particularly to a microstrip for wireless communication and a method for designing the same.

2. Description of Related Art

Microstrips are widely used in wireless communication devices for transmitting wireless signals. In use, microstrips generally transmit wireless signals using their quasi-transverse electric magnetic modes (QTEM). A QTEM of a microstrip has an odd mode and an even mode, and both of the two modes can be used to transmit wireless signals. However, the two modes generally have different phase velocities of the transmission of the wireless signals. When the two modes of the microstrip are synchronously used to transmit wireless signals, differences between the phase velocities of the two modes may adversely affect signal transmission quality. Furthermore, common microstrips usually have large lengths (for example, a microstrip for transmitting wireless signals in a frequency of about 2.5 GHz may have a length of about 27 mm), which may adversely affect miniaturization of wireless communication devices using these microstrips.

Therefore, there is room for improvement within the art.

BRIEF DESCRIPTION OF THE DRAWINGS

Many aspects of the present microstrip and method for designing the same can be better understood with reference to the following drawings. The components in the various drawings are not necessarily drawn to scale, the emphasis instead being placed upon clearly illustrating the principles of the present microstrip and method for designing the same. Moreover, in the drawings, like reference numerals designate corresponding parts throughout the figures.

FIG. 6 is a diagram of parameters of one exemplary embodiment of the microstrip shown in FIG. 1.

DETAILED DESCRIPTION

Figure 1:
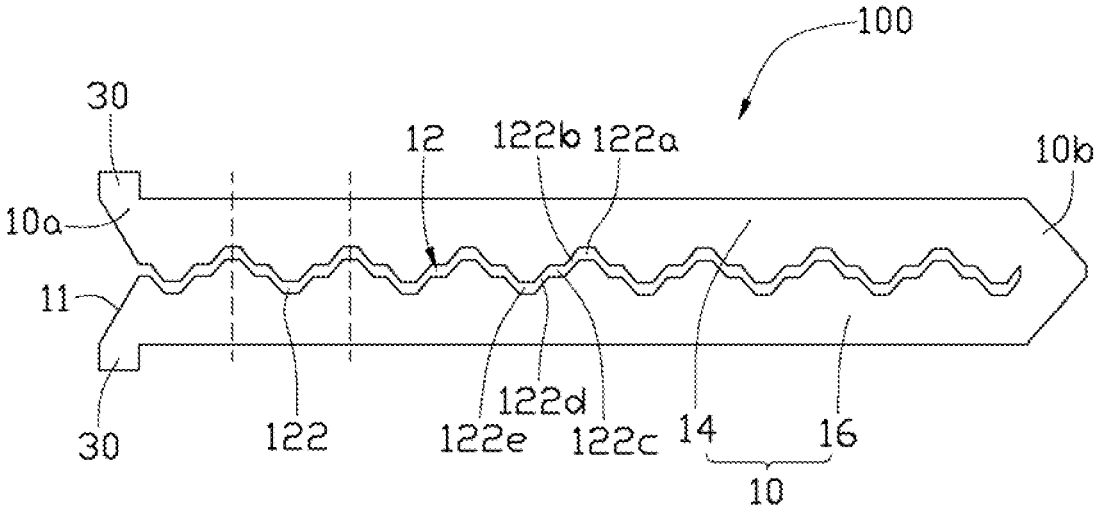
FIG. 1 is a schematic view of a microstrip, according to an exemplary embodiment.

FIG. 1 schematically shows a microstrip 100, according to an exemplary embodiment. The microstrip 100 can be used in a wireless communication device (not shown), such as a mobile phone, a personal digital assistant (PDA), or a laptop computer, for transmitting wireless signals and regulating impedance of inner circuitry of the wireless communication device.

The microstrip 100 is a planar sheet made of metal. In this exemplary embodiment, the microstrip 100 includes a main body 10 and two connection bodies 30. The main body 10 is a straight strip. The main body 10 has two opposite ends 10*a*, 10*b*. A V-shaped gap 11 is defined in the end 10*a*. A width of the end 10*b* gradually decreases, and the end 10*b* is thereby configured to be V-shaped. The two connection bodies 30 are rectangular extending portions respectively formed on two opposite sides of the main body 12, and the two connection bodies 30 are positioned adjacent to the end 10*a*.

A slot 12 is defined in the main body 10, and two side portions 14, 16 are correspondingly formed at two sides of the slot 12. The two side portions 14, 16 are connected to each other at the end 10*b*, are separated from each other at the end 10*a* by the slot 12 and the gap 11. The slot 12 includes a plurality of zigzag units 122. Each zigzag unit 122 includes a first level section 122*a*, two first inclined sections 122*b*, two second level sections 122*c*, two second inclined sections 122*d*, and two third level sections 122*e*, which are all straight slot sections. The second level portions 122*c* are positioned along a midline (not shown) of the main body 12. The first level section 122*a* and the first inclined sections 122*b* are positioned at one side of the midline of the main body 12 (i.e., adjacent to the side portion 14), and the second inclined sections 122*d* and the third level sections 122*e* are positioned at another side of the midline of the main body 12 (i.e., adjacent to the side portion 16). The first level section 122*a* and the third sections 122*e* are all parallel to the midline of the main body 10, i.e., parallel to the second level portions 122*c*.

In each zigzag unit 122, the two first inclined sections 122*b* respectively communicate with two ends of the first level section 122*a*. Each first inclined section 122*b* forms an angle of about forty five degrees with the first level section 122*a*, and the two first inclined sections 122*b* extend away from each other and then respectively communicate with the two second level sections 122*c*. The two second level sections 122*c* respectively communicate with the two second inclined sections 122*d*. Each second inclined section 122*d* forms an angle of about forty five degrees with the second level section 122*c* communicating therewith, and the two second inclined sections 122*d* extend away from each other and then respectively communicate with the two third level sections 122*e*. Every two adjacent zigzag units 122 shares a third level section 122*e*, and thereby communicate with each other and define the slot 122. An end of the slot 122 opens at the end 10*a* of the main body 10 and communicates with a middle portion of the gap 11.

The microstrip 100 can transmit wireless signals using its quasi-transverse electric magnetic modes (QTEM). Similar to that of common microstrips, the QTEM of the microstrip 100 has an odd mode and an even mode, and both the two modes can be used to transmit wireless signals. In use, feed signals are respectively input to and output from the main body 10 through the two connection bodies, and thus the feed signals generate the QTEM in the main body 10 for receiving and sending wireless communication signals. The slot 122 can adjust a length of a transmission path of signals transmitted by the odd mode. Thus, when two modes of the microstrip 100 are synchronously used to transmit wireless signals, the phase velocity of transmitting wireless signals by the odd mode can be adjusted to equal the phase velocity of transmitting wireless signals by the even mode. In this way, difference between the phase velocities of transmitting wireless signals by the two modes of the microstrip 100 is prevented, and thus the microstrip 100 obtains better signal transmission quality than conventional microstrips.

Figure 2:
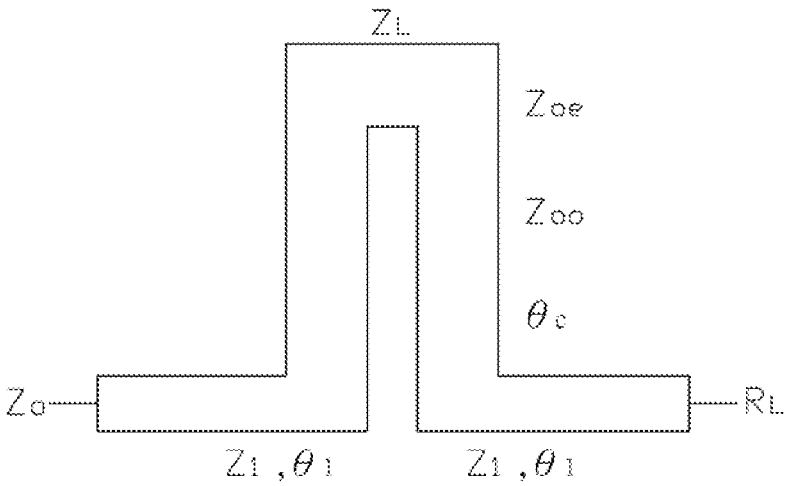
FIG. 2 is a schematic view of an impedance equivalent model of one exemplary embodiment of the microstrip shown in FIG. 1.

FIGS. 2-5 illustrate various models and circuits that are used for identifying relative parameters of the microstrip 100. FIG. 2 shows an impedance equivalent model of the microstrip 100, wherein $Z_0$ is an input impedance of the microstrip 100, $Z_L$ is an impedance generated by the microstrip 100 itself, $R_L$ is an impedance of a load of the microstrip 100, $\theta_1$ is a length of each connection body 30, $Z_1$ is an impedance of each connection body 30, $Y_1$ is an admittance of each connection body 30, θc is a length of the side portion 14/16, Zoo is an odd mode impedance of the main body 10, and Zoe is an even mode impedance of the main body 10. In fabrication, a width of the connection bodies 30 can affect $Z_1$, $\theta_1$ and θc can affect frequencies of wireless signals received/sent by the microstrip 100, and a ratio of a width of the side portion 14/16 to a width of the slot 122 can affect Zoo and Zoe.

Figure 3:
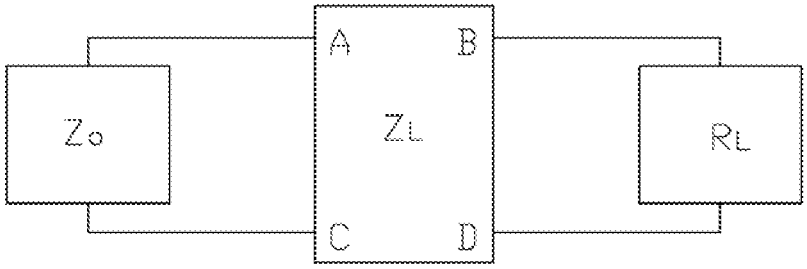
FIG. 3 is a circuit diagram of an equivalent circuit of one exemplary embodiment of the microstrip shown in FIG. 1.

FIG. 3 shows a circuit diagram of an equivalent circuit of the microstrip 100. The equivalent circuit of the microstrip 100 is a two-port network that includes an input port (not labeled) connected to an input having the input impedance $Z_0$ and an output port (not labeled) connected to a load having the load impedance $R_L$. FIG. 3 further shows these parameters, A is a reverse transfer voltage ratio in condition that the output port is in an open circuit, B is a reverse transfer impedance in condition that the output port is in a short circuit, C is a forward transfer admittance in condition that the output port is in the open circuit, and D is a reverse transfer current ratio in condition that the output port is in the short circuit. Thus, $Z_0$ can be calculated in this formula:

$$Z_0 = \frac{AR_L + B}{CR_L + D}$$

Figure 4:
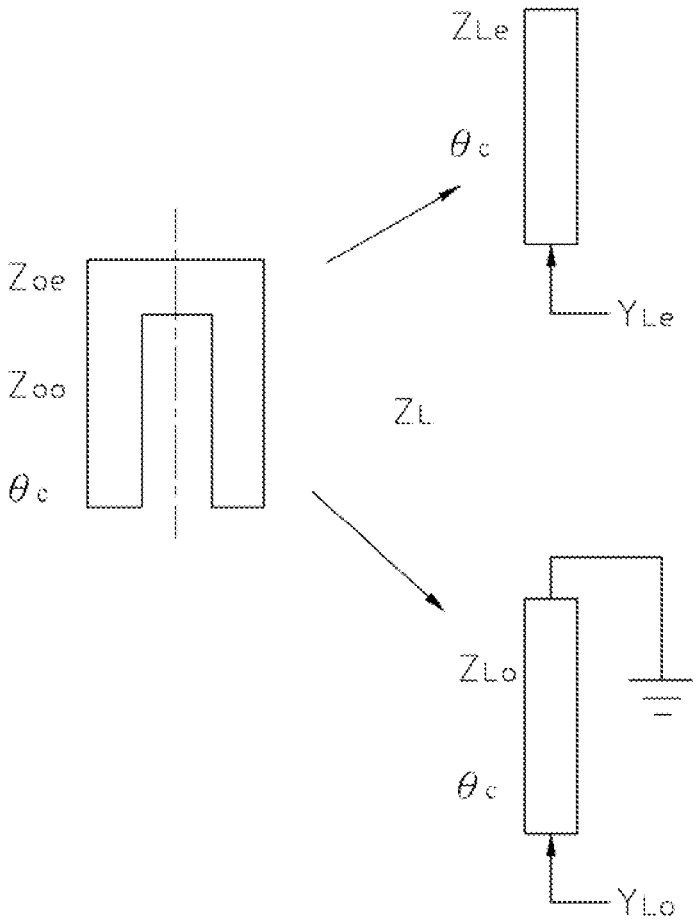
FIG. 4 is a schematic view of a loop transmission character equivalent model of one exemplary embodiment of the microstrip shown in FIG. 1.

FIG. 4 shows a loop transmission character equivalent model of the microstrip 100, wherein $Z_{Lo}$ is an odd mode load impedance of the side portion 14/16, $Z_{Lo}$ is an odd mode load impedance of the side portion 14/16, $Y_{Lo}$ is an odd mode load admittance of the side portion 14/16, $Z_{Le}$ is an even mode load impedance of the side portion 14/16, and $Y_{Le}$ is an even mode load admittance of the side portion 14/16. According to characters of QTEM of microstrips, above parameters have these relations:

$$Z_{Lo} = Z_{oo}\frac{Z_L + jZ_{oo}\tan\theta_c}{Z_{oo} + jZ_L\tan\theta_c}, \text{ and}$$

$$Z_{Le} = Z_{oe}\frac{Z_L + jZ_{oe}\tan\theta_c}{Z_{oe} + jZ_L\tan\theta_c}$$

According to impedance characters of microstrips, $Z_L$ can be regarded as zero in the odd mode of the microstrip 100 and be regarded as infinity in the even mode of the microstrip 100. Therefore, it can be inferred that $$Z_{Lo} = jZ_{oo}\tan\theta_c,\ Y_{Lo} = \frac{1}{Z_{Lo}} - jY_{oo}\cot\theta_c; \text{ and}$$

$$Z_{Le} = -jZ_{oe}\cot\theta_c,\ Y_{Le} = \frac{1}{Z_{Le}} = jY_{oe}\tan\theta_c$$

Furthermore, when the microstrip 100 is used, according to signal transmission characters of microstrips, it can be inferred that $$\begin{bmatrix} A & B \\ C & D \end{bmatrix} = \begin{bmatrix} \cos\theta_1 & jZ_1\sin\theta_1 \\ jY_1\sin\theta_1 & \cos\theta_1 \end{bmatrix} \begin{bmatrix} \frac{Z_{11}}{Z_{21}} & \frac{|Z|}{Z_{21}} \\ \frac{1}{Z_{21}} & \frac{Z_{22}}{Z_{21}} \end{bmatrix} \begin{bmatrix} \cos\theta_1 & jZ_1\sin\theta_1 \\ jY_1\sin\theta_1 & \cos\theta_1 \end{bmatrix},$$

wherein $$Z_{11} = \frac{Y_{Le} + Y_{Lo}}{2Y_{Le}Y_{Lo}} = \frac{1}{2}j(Z_{oo}\tan\theta_c - Z_{oe}\cot\theta_c) = Z_{22},$$

$$Z_{12} = \frac{Y_{Lo} - Y_{Le}}{2Y_{Le}Y_{Lo}} = -\frac{1}{2}j(Z_{oo}\tan\theta_c + Z_{oe}\cot\theta_c) = Z_{21}, \text{ and}$$

$$|Z| = Z_{oo}Z_{oe}$$

When above-detailed formulas are taken in combination and the parameters A, B, C, D are described by relations between other parameters, these following equations are obtained:

$$\frac{1}{2}(Z_{oe}\cos^2\theta_c - Z_{oo}\sin^2\theta_c)(Z_1 - Y_1R_LZ_0)\sin2\theta_1 + (Z_{oo}Z_{oe} - R_LZ_0)\cos^2\theta_1\cos\theta_c\sin\theta_c + (Z_{oo}Z_{oe}Y_1^2R_LZ_0 - Z_1^2)\sin^2\theta_1\cos\theta_c\sin\theta_c = 0\Lambda(a)$$

$$\frac{1}{2}[(Z_{oo}Z_{oe}Y_1 + Z_1)\sin2\theta_1\cos\theta_c\sin\theta_c + (Z_{oo}\sin^2\theta_C - Z_{oe}\cos^2\theta_C)\cos2\theta_1](R_L - Z_0) = 0\Lambda(b)$$

$$\frac{1}{2}(Z_{oe}\cos^2n\theta_c - Z_{oo}\sin^2n\theta_c)(Z_1 - Y_1R_LZ_0)\sin2n\theta_1 + (Z_{oo}Z_{oe} - R_LZ_0)\cos^2n\theta_1\cos n\theta_c\sin n\theta_c + (Z_{oo}Z_{oe}Y_1^2R_LZ_0 - Z_1^2)\sin^2n\theta_1\cos n\theta_c\sin n\theta_c = 0\Lambda(c)$$

$$\frac{1}{2}\begin{bmatrix} (Z_{oo}Z_{oe}Y_1 + Z_1)\sin2n\theta_1\cos n\theta_c\sin n\theta_c + \\ (Z_{oo}\sin^2n\theta_C - Z_{oe}\cos^2n\theta_C)\cos2n\theta_1 \end{bmatrix}(R_L - Z_0) = 0\Lambda(d)$$

Thus, the parameters $\theta_1$, $Z_1$, θc, $Z_{oo}$, and $Z_{oe}$ can be identified according to above equations (a), (b), (c), (d). The number n is a ratio of a predetermined relatively high frequency $f_1$ of wireless signals transmitted by the microstrip 100 to a predetermined relatively low frequency $f_0$ of wireless signals transmitted by the microstrip 100. As shown in FIG. 6, in this exemplary embodiment, the frequencies $f_0$ and $f_1$ are respectively 2.5 GHz and 5.8 GHz, and thus n=5.8 GHz/2.5 GHz=2.82. Since the calculated parameters are more than the equations, each of the parameters $\theta_1$, $Z_1$, θc, $Z_{oo}$, and $Z_{oe}$ can have different values, such that the microstrip 100 can be in different types.

Figure 5:
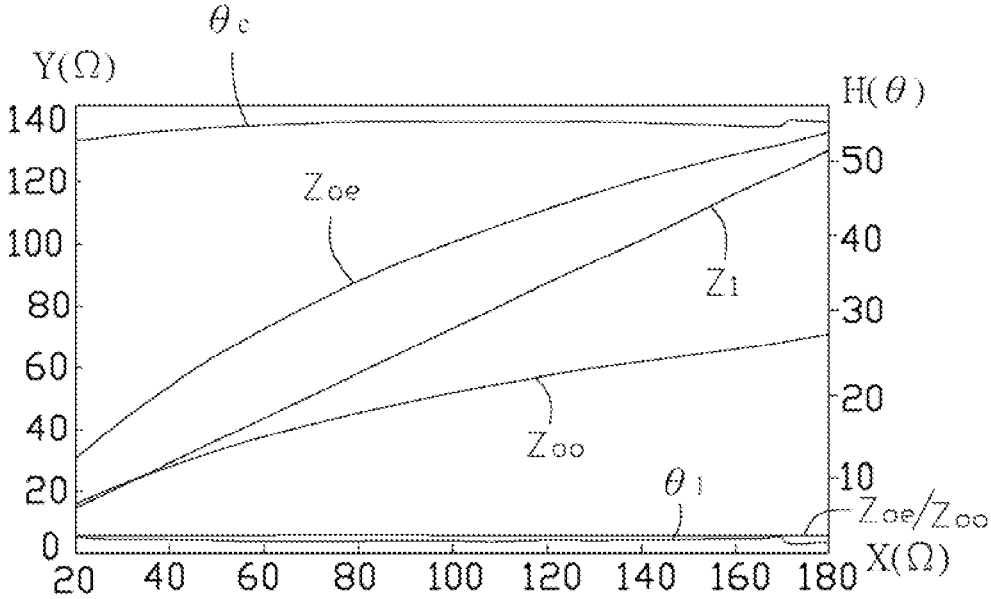
FIG. 5 is a diagram of mathematic relations between parameters of one exemplary embodiment of the microstrip shown in FIG. 1.

FIG. 5 shows mathematic relations between the parameters $\theta_1$, $Z_1$, θc, $Z_{oo}$, $Z_{oe}$ and the load impedance $R_L$ of the microstrip 100 inferred from the equations (a), (b), (c), (d). Referring to FIG. 5, X axis means value of $R_L$, Y axis means values of $Z_1$, $Z_{oo}$, and $Z_{oe}$, and H axis means values of electrical lengths of $\theta_1$ and θc, wherein the electrical lengths of $\theta_1$ and θc are described as degrees. Furthermore, the electrical lengths of $\theta_1$ and θc described as degrees can be transformed into linear lengths of $\theta_1$ and θc using typical methods, such as TXline. When $R_L$ of the microstrip 100 is predetermined according to actual use, the parameters $\theta_1$, $Z_1$, θc, $Z_{oo}$, $Z_{oe}$ can be identified according to the mathematic relations shown in FIG. 5, and thus the microstrip 100 can be fabricated according to the parameters $\theta_1$, $Z_1$, θc, $Z_{oo}$, $Z_{oe}$.

FIG. 6 shows two groups of usable parameters $\theta_1$, $Z_1$, θc, $Z_{oo}$, $Z_{oe}$ of the microstrip 100. Referring to FIG. 6, when $R_L$ of the microstrip 100 is 100Ω, a total length of the microstrip 100 is about 12.57 mm; when $R_L$ of the microstrip 100 is 180Ω, the total length of the microstrip 100 is about 13.23 mm. Compared with common microstrips, the microstrip 100 is much smaller in size.

Figure 7:
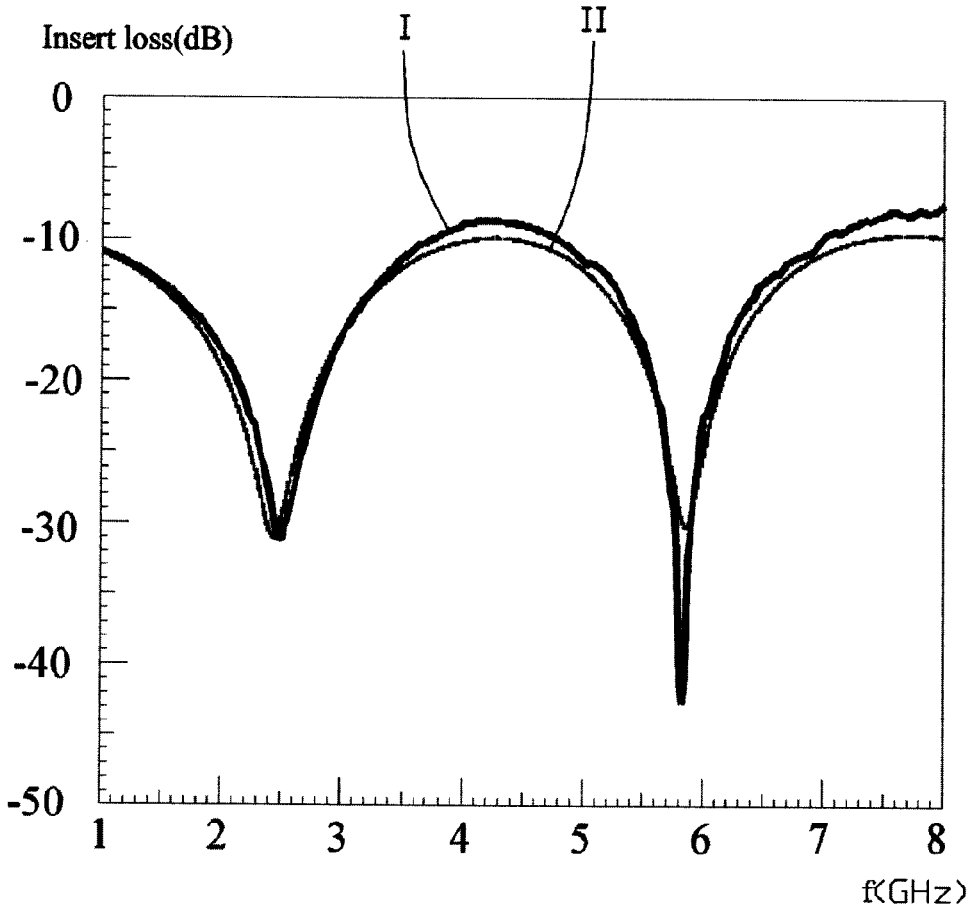
FIG. 7 is a diagram of an insert loss of one exemplary embodiment of the microstrip shown in FIG. 1, wherein an impedance of a load of the microstrip is 100Ω.
Figure 8:
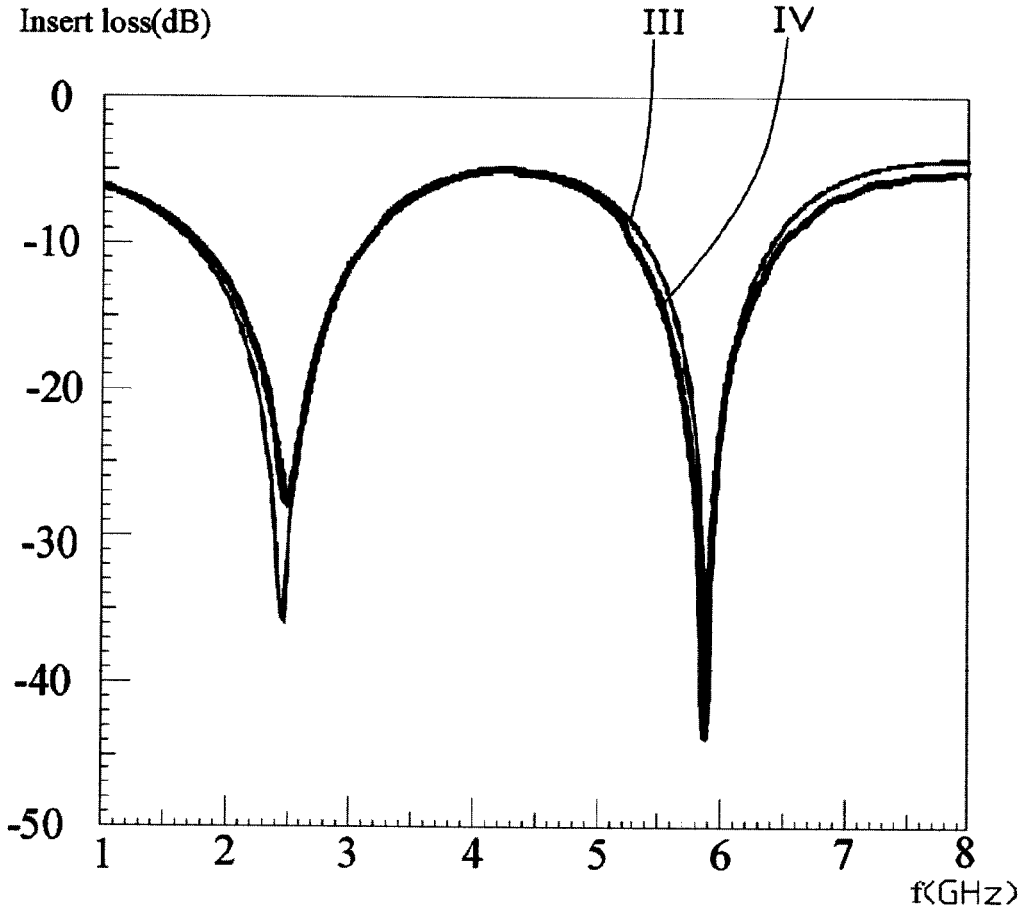
FIG. 8 is a diagram of an insert loss of one exemplary embodiment of the microstrip shown in FIG. 1, wherein an impedance of a load of the microstrip is 180Ω.
Figure 9:
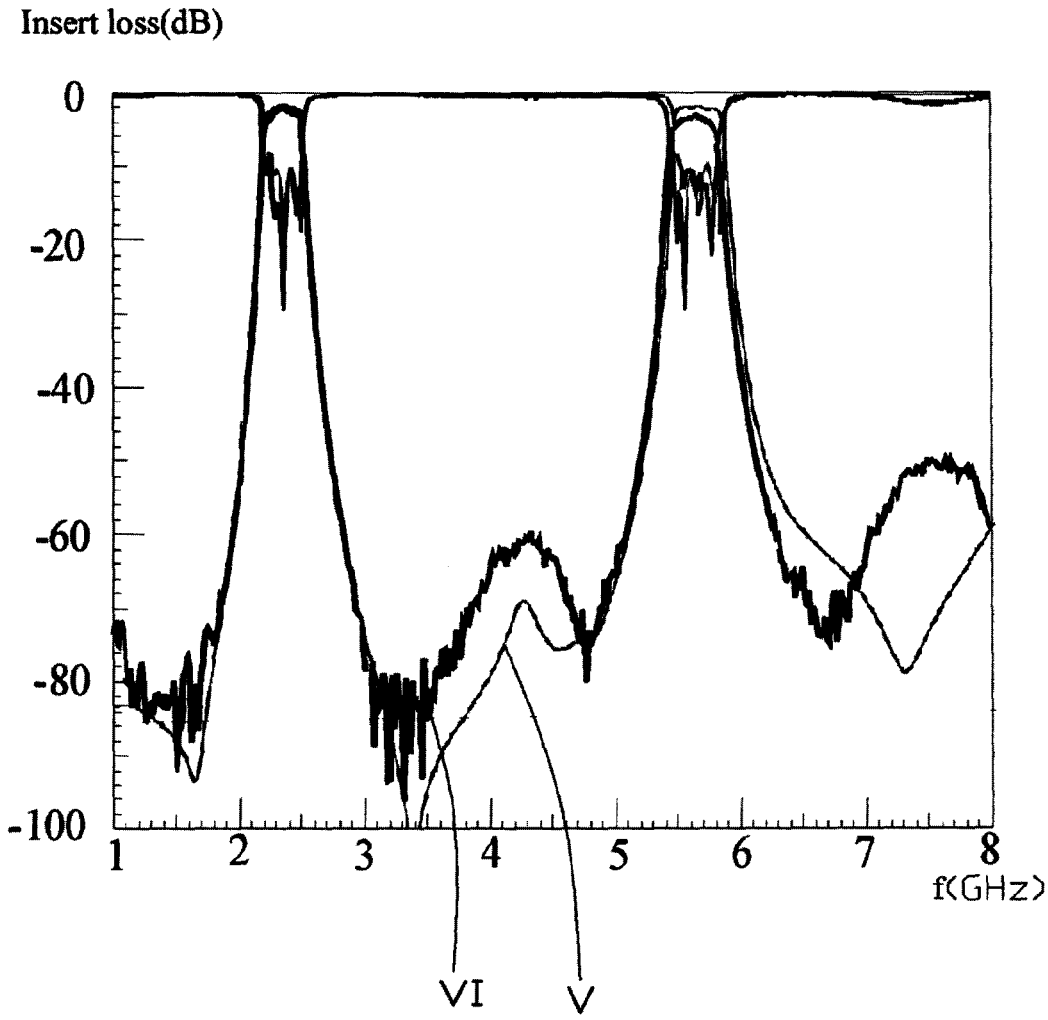
FIG. 9 is a diagram of an insert loss of one exemplary embodiment of a filter using one exemplary embodiment of the microstrip shown in FIG. 1.

The microstrip 100 can be widely used in communication devices. FIG. 7 shows an insert loss of the microstrip 100 used to transmit wireless signals, with a load impedance $R_L$ of 100Ω. Curves I, II respectively illustrate the insert loss of the microstrip 100 calculated by analog software and measured in experiments. FIG. 8 shows an insert loss of the microstrip 100 used to transmit wireless signals, with a load impedance $R_L$ of 180Ω. Curves III, IV respectively illustrate the insert loss of the microstrip 100 calculated by analog software and measured in experiments. As shown in FIGS. 7 and 8, when the microstrip 100 with a load impedance of 100Ω or 180Ω is used to transmit wireless signals in frequencies of about 2.5 GHz and 5.8 GHz, the insert loss of the microstrip 100 is acceptable. FIG. 9 shows an insert loss of a filter using the microstrip 100. Curves V, VI respectively illustrate the insert loss of the microstrip 100 calculated by analog software and measured in experiments. As shown in FIG. 9, when the microstrip 100 is used to allow wireless signals in frequencies of about 2.5 GHz and 5.8 GHz to pass, the insert loss of the microstrip 100 is acceptable.

It is to be further understood that even though numerous characteristics and advantages of the present embodiments have been set forth in the foregoing description, together with details of structures and functions of various embodiments, the disclosure is illustrative only, and changes may be made in detail, especially in matters of shape, size, and arrangement of parts within the principles of the present invention to the full extent indicated by the broad general meaning of the terms in which the appended claims are expressed.

What is claimed is:

1. A microstrip for wireless communication, comprising:

a main body defining a slot therein, the slot including a plurality of zigzag units; and two connection bodies formed on the main body; wherein feed signals are input to and output from the main body through the two connection bodies to generate quasi-transverse electric magnetic modes (QTEM) in the main body for transmitting wireless signals, wherein the QTEM includes an odd mode and an even mode that are both capable of transmitting the wireless signals; when the odd mode and the even mode synchronously transmits the wireless signals, the slot adjusts a length of a transmission path of signals transmitted by the odd mode, such that the phase velocity of transmitting the wireless signals by the odd mode is adjusted to substantially equal to the phase velocity of transmitting the wireless signals by the even mode.

2. The microstrip as claimed in claim 1, wherein the microstrip is a planar sheet made of metal, the main body is a straight strip, and the two connection bodies are extending portions respectively formed on two opposite sides of the main body.

3. The microstrip as claimed in claim 2, wherein one end of the main body defines a gap communicating with the slot, and another end of the main body is configured to be V-shaped.

4. The microstrip as claimed in claim 1, wherein each zigzag unit includes a first level section, two first inclined sections communicating with the first level section, two second level sections respectively communicating with the two first inclined sections, two second inclined sections respectively communicating with the two second level sections, and two third level sections respectively communicating with the two second inclined sections; all the level sections and inclined sections being straight slot sections.

5. The microstrip as claimed in claim 4, wherein the second level portions are positioned along a midline of the main body, the first level section and the first inclined sections are positioned at one side of the midline of the main body, and the second inclined sections and the third level sections are positioned at another side of the midline of the main body.

6. The microstrip as claimed in claim 5, wherein the first level section and the third sections are all parallel to the midline of the main body and the second level portions.

7. The microstrip as claimed in claim 6, wherein the two first inclined sections respectively communicates with two ends of the first level section, each first inclined section forms an angle of forty five degrees with the first level section, and the two first inclined sections extend away from each other and then respectively communicate with the two second level sections; the two second level sections respectively communicate with the two second inclined sections, and each second inclined section forms an angle of forty five degrees with the second level section communicating therewith; the two second inclined sections extend away from each other and then respectively communicate with the two third level sections.

8. The microstrip as claimed in claim 7, wherein every two adjacent zigzag units shares a third level section.

9. The microstrip as claimed in claim 1, wherein the microstrip transmits wireless signals in frequencies of about 2.5 GHz and 5.8 GHz.

10. A method for designing a microstrip that includes a main body and two connection bodies, the main portion defining a slot and including two side portions, comprising:

determining an impedance equivalent model, an equivalent circuit, and a loop transmission character equivalent model of the microstrip;

determining mathematic relations between a length of each connection body, an impedance of each connection body, a length of each side portion, an odd mode impedance of the main body, and an even mode impedance of the main body according to the impedance equivalent module, the equivalent circuit, and the loop transmission character equivalent model; and identifying values of above parameters of the microstrip according to the mathematic relations therebetween.

11. The method as claimed in claim 10, wherein the length of each connection body, the impedance of each connection body, the length of each side portion, the odd mode impedance of the main body, and the even mode impedance of the main body are further identified according to an impedance of a load of the microstrip.

* * * * *